US010287151B2

(12) United States Patent
Comin et al.

(10) Patent No.: US 10,287,151 B2
(45) Date of Patent: May 14, 2019

(54) APPARATUS FOR FILLING CONTAINERS

(71) Applicant: NESTEC S.A., Vevey (CH)

(72) Inventors: Andrea Comin, Vittel (FR); Damien Kannengiesser, Golbey (FR)

(73) Assignee: Nestec S.A., Vevey (CH)

( * ) Notice: Subject to any disclaimer, the term of this patent is extended or adjusted under 35 U.S.C. 154(b) by 351 days.

(21) Appl. No.: 15/371,962

(22) Filed: Dec. 7, 2016

(65) Prior Publication Data

US 2017/0158479 A1 Jun. 8, 2017

(30) Foreign Application Priority Data

Dec. 7, 2015 (EP) ..... 15198154

(51) Int. Cl.

| | |
|---|---|
| ***B67C 3/00*** | (2006.01) |
| ***B67C 3/28*** | (2006.01) |
| ***B67C 3/20*** | (2006.01) |
| ***B67C 3/26*** | (2006.01) |

(52) U.S. Cl.

CPC ..... *B67C 3/208* (2013.01); *B67C 3/002* (2013.01); *B67C 3/26* (2013.01); *B67C 3/282* (2013.01)

(58) Field of Classification Search

CPC ..... B67C 3/028; B67C 3/002; B67C 3/26; B67C 3/282

See application file for complete search history.

(56) References Cited

U.S. PATENT DOCUMENTS

| | | | | |
|---|---|---|---|---|
| 9,120,066 | B2 | 9/2015 | Meinzinger | |
| 2014/0345745 | A1* | 11/2014 | Fahldieck | B67C 3/20 141/9 |

FOREIGN PATENT DOCUMENTS

| | | |
|---|---|---|
| EP | 0265128 | 4/1988 |
| WO | 2009129937 | 10/2009 |

* cited by examiner

*Primary Examiner* — Jason K Niesz

(74) *Attorney, Agent, or Firm* — K&L Gates LLP

(57) ABSTRACT

An apparatus for filling containers comprises a nozzle for establishing fluid communication with a container, a filling line extending between the nozzle and a source of a product fluid, a filling valve in the filling line, an auxiliary line extending from the nozzle to a drain, and a drain isolation valve in the auxiliary line; further comprising at least one additive line which extends from a junction with the auxiliary line between the nozzle and the drain valve to an additive fluid source; and a dosing valve in the auxiliary line between the nozzle and the at least one additive line, which permits a predetermined volume of additive fluid to flow through the auxiliary line to the nozzle.

13 Claims, 2 Drawing Sheets

APPARATUS FOR FILLING CONTAINERS

PRIORITY CLAIM

This application claims the benefit of and priority to European Patent Application No. 15198154.5 filed on Dec. 7, 2015, the entire disclosure of which is hereby incorporated by reference.

FIELD OF THE INVENTION

The present invention concerns an apparatus for filling containers. More specifically, it concerns an apparatus for filling containers with a fluid product, comprising a means for dosing an additive into said fluid product, as well as a method for its use.

BACKGROUND OF THE INVENTION

In the industrial engineering arts, a common task is the dispensing of liquid, gel, or otherwise fluid products into individual packages for distribution and sale.

In particular, in the food and beverage arts, apparatuses for filling containers such as bottles, jars, and the like are well known, for instance as a part of a larger continuous production and packaging operation.

Generally speaking, such container-filling apparatuses comprise a nozzle with a mouth adapted to cooperate with a container, and permit the fluid product to be conducted from a source such as a production line or reservoir in order to be dispensed through the nozzle into the container.

In addition to simple installations where the container is filled with a single homogeneous product, it is well known to produce fluid products by means of adding a volume of an additive fluid to a base fluid in a predetermined proportion.

By adding one or more additives to a base, a single production line may be employed to produce a large variety of different product variations. For instance, a line for bottling sodas can produce a variety of different beverages by altering the type and volume of syrup that is mixed with the carbonated water.

These additives are dispensed into the containers by a separate dosing machine, which is configured to dispense a quantity of the additive into the container. This may be performed either immediately prior to or after the container is filled with the base fluid. Such additive-dosing machines are generally configured to provide a precise amount of the additive, so as to maintain tight control over the proportion of additive to base.

The base-additive product packaging systems known in the art, despite their versatility, are disadvantageous in that a great deal of floor space is required to provide such capacity in a container filling production line. This increased space obligation may limit the capacity that may be achieved in a new-installation production line, relative to one without an additive-dispensing system.

Moreover, adapting existing production lines may not be feasible, as each additive-dispensing apparatus added to the production line requires a commitment of floor space that may render adapting an existing operation infeasible.

It is therefore desirable to provide a means for dispensing additives into product containers that resolves at least some of the problems enumerated above.

SUMMARY OF THE INVENTION

To this end, the invention is directed towards an apparatus for filling containers, comprising a nozzle with a mouth configured to cooperate with a container and establish fluid communication therewith; a filling line extending from said nozzle and establishing fluid communication between said mouth and a primary fluid source configured to introduce a volume of a product fluid into said filling line; a filling valve selectively blocking fluid communication through said filling line; an auxiliary line extending from said nozzle and establishing fluid communication between said mouth and a drain; and a drain isolation valve disposed in said auxiliary line and selectively blocking fluid communication with said drain.

According to a first aspect, the invention further comprises at least one additive line extending from a junction with said auxiliary line between said nozzle and said drain valve, and establishing fluid communication between said auxiliary line and an additive fluid source configured to introduce a volume of an additive fluid into said at least one additive line; and a dosing valve disposed in the auxiliary line between the nozzle and the at least one additive line, said dosing valve being configured to permit a predetermined volume of additive fluid to flow through said auxiliary line to said nozzle.

An apparatus so configured is advantageous in that it employs the pre-existing auxiliary line to inject the additive fluid into the product fluid. The container-filling apparatus will thereby be provided with additive-dosing capability without requiring the installation of a separate dosing apparatus into the system, and with a minimal amount of added equipment overall.

Furthermore, the auxiliary line maintains its ability to be used for cleaning the apparatus as well as providing the additive-dosing capability, by using the auxiliary line to circulate a cleaning fluid. Because of this built-in cleaning capability, the apparatus can rapidly switch between dispensing product fluid with or without additives, with a minimum of changeover time.

In a possible embodiment, there is provided a plurality of additive fluid sources, each in communication with the nozzle through the auxiliary line and a respective additive line, each of said respective additive lines comprising an additive isolation valve.

In this way, a single container-filling apparatus is adapted to produce containers filled with a variety of different additives, with a combination of different additives, or with no additives whatsoever. In this way, the container-filling installation achieves a great deal of flexibility without requiring any further extra floor space.

In a preferred embodiment, each at least one additive line further comprises an additive isolation valve selectively blocking fluid communication through said secondary filling line.

In this way the dosing of multiple additives alternatively or simultaneously in installations so configured is simplified.

In particular, when a plurality of additive fluids is to be mixed into the product fluid, the isolation valves may be opened to a degree according to the relative proportions of their respective additive fluids.

Advantageously, the apparatus further comprises a flow meter disposed on at least one additive line.

In this way, the exact volume of additive dispensed into the product fluid can be measured and, in concert with an additive isolation valve as mentioned above, controlled.

In a possible embodiment, the dosing valve is a proportional valve or a two-position valve.

By employing one of these two forms of valve, the flow of the additive fluid may be tightly controlled, and with a minimum of adaptation from the control methods commonly known in the art.

According to a second aspect, there is provided an installation comprising a plurality of container-filling apparatuses as described above, at least some of said plurality of container-filling apparatuses having a common filling line and a common auxiliary line.

Such an installation is advantageous in that it realizes the advantages of the apparatus, and of the associated methods described above, in a production environment.

In particular, the use of a common filling line and auxiliary line among at least some of the apparatuses will simplify both the construction of the apparatus and its integration into a production line.

According to a third aspect, there is provided a method for producing a fluid product comprising an additive, comprising the steps of providing a container-filling apparatus as described above; opening the filling valve, thereby causing a volume of a product fluid to flow through said filling line from said primary fluid source through the mouth of the nozzle; and opening the dosing valve and injecting a volume of an additive fluid into the at least one additive line, said volume of fluid being subsequently conducted through the auxiliary line and into the nozzle, the additive fluid being thereby combined with the volume of product fluid flowing through said mouth of said nozzle.

Such a method is advantageous in that it realizes the advantages of the apparatus as discussed herein, in the production of fluid products comprising precise doses of desired additive fluids.

Advantageously, the dosing valve is a proportional valve, the degree to which said dosing valve is opened being proportionate to the concentration of the additive fluid in the liquid product.

Alternatively, the dosing valve is a two-position valve, said dosing valve being opened during the injecting of the volume of additive fluid for a duration of time proportionate to the concentration of the additive fluid in the liquid product.

In this way, a simple and consistent dosing of the additive fluid during the production of the fluid product is achieved.

In a possible embodiment, the additive fluid is an edible flavouring concentrate.

In this way, the advantages of the invention are applied to the production of food and beverage products, and in particular the high-speed, high-volume production thereof.

According to a fourth aspect, the invention is directed towards a method for filling a sequence of containers with a fluid product, comprising the steps of providing a container-filling apparatus as described above, pre-determining the volume of at least one additive fluid in each container of said sequence of containers; and for each of said containers in said sequence of containers, opening the filling valve, thereby causing a volume of a product fluid to flow through said filling line from said primary fluid source through the mouth of the nozzle and into one of a plurality of containers; and selectively injecting a volume of at least one additive fluid into a respective at least one additive line according to said pre-determined volume, said volume of said at least one additive fluid being subsequently conducted through the auxiliary line, the nozzle, and into said one of said plurality of containers.

This is advantageous in that it will produce a sequence of containers, each filled with a product fluid and possibly at least one additive fluid. In this way, containers having several additive compositions can be produced rapidly and according to desired proportions.

Preferably, the method further comprises a step for applying a distinctive marking to each of the plurality of containers, said distinctive marking corresponding to the additive liquid or liquids, or absence thereof, injected into each of said plurality of containers.

Preferably, the method further comprises a step for gathering the containers produced over at least one iteration of the sequence into a package.

In this way, packages of containers having a desired mixed composition and appropriate labelling are produced without any substantial additional effort or expenditure. The conditioning of such containers for commercial sale is thus facilitated.

According to a fifth aspect, the invention is directed towards a container filled with a fluid product produced by the method described above.

Such a container is advantageous in that it embodies the advantages of the fluid-product-production method described above; specifically, in that it is provided with the at least one additive fluid in a quick, economical, and flexible manner.

The container definition should encompass every type of container containing fluid and especially bottles and preferably plastic bottles such as PET bottles.

BRIEF DESCRIPTION OF THE DRAWINGS

Additional features and advantages of the present invention are described in, and will be apparent from, the description of the presently preferred embodiments which are set out below with reference to the drawings in which.

DETAILED DESCRIPTION OF THE INVENTION

Figure 1:
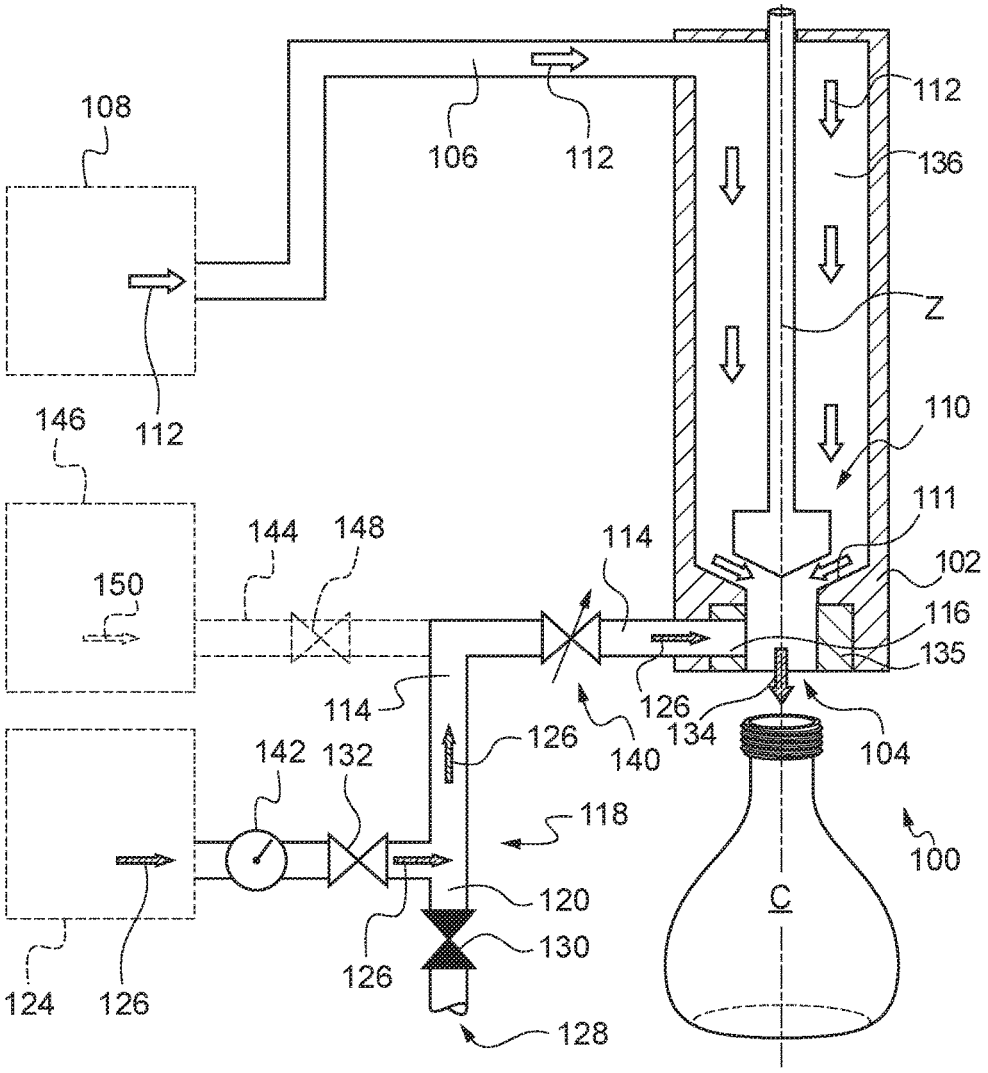
FIG. 1 is a schematic drawing of a container-filling apparatus according to an embodiment of the invention, during the filling of a container.

In FIG. 1, there is depicted an exemplary container-filling apparatus 100, which comprises a nozzle 102. The nozzle 102 is adapted to cooperate with a container C by way of a mouth 104 disposed in the nozzle 102.

The nozzle 102 and the mouth 104 are configured such that they will cooperate with the container C, for instance by sealing against the container C, or by other means such as a spout or nipple which facilitate the fluid communication between the two. The exact configuration of the interface between the nozzle 102 & mouth 104 and the container C, and the means of creating a seal between them, are thus primarily a function of the application in which the apparatus 100 is to be employed. However, the depiction of FIG. 1 is simplified for illustrative purposes.

The nozzle 102 is fed by a filling line 106, which puts the nozzle 102 in fluid communication with a primary fluid source 108. In the nozzle 102 there is provided a filling valve 110, which serves to selectively block the flow of the product fluid 112 from the nozzle 102.

The filling valve 110, when brought into abutment with a valve seat 111 in the nozzle 102, blocks fluid communication between the filling line 106 and the mouth 104. Thus, there is provided a means for actuating the filling valve 110 by moving it along the Z axis of the nozzle 102. Depending on the configuration of the apparatus 100, this may be a pneumatic or hydraulic actuator, an electrical motor or solenoid, a mechanical linkage, or some other appropriate control mechanism.

The primary fluid source 108 serves to introduce a volume of fluid into the filling line 106. Since FIG. 1 depicts a step for filling a container, the volume of fluid is here represented by a product fluid 112. The product fluid 112 is introduced into the filling line 106 and conducted to the nozzle 102.

It will be noted that the primary fluid source 108 can, depending on the implementation of the invention, take many different forms, which is why it is depicted schematically in FIG. 1. For instance, it may be in the form of a reservoir with a pump, or a connection to some sort of conditioning and preparation apparatus, or even the output of a separate production line on which the product fluid 112 is produced.

In any case, however, the primary fluid source 108 should be capable of injecting a volume of a product fluid 112 into the filling line 106, at a pressure and flow rate appropriate for the dimensions of the application in question.

The filling line 106 passes from the primary fluid source 108 through the filling valve 110, and ultimately connects with the nozzle 102. In this embodiment, the filling line 106 connects with the nozzle 102 such that the filling line 106 and the mouth 104 are all aligned along a longitudinal axis Z. This will serve to promote a laminar flow of the product fluid 112 through the nozzle 102, out the mouth 104, and into the container C.

The apparatus is further provided with an auxiliary line 114. The auxiliary line 114 extends from an injection port 116 in the nozzle 102, to a junction 118. At the junction 118, the auxiliary line 114 splits into a drain line 120 and an additive line 122.

The additive line 122 extends between the junction 118 and an additive fluid source 124, thereby placing the additive fluid source 124 in fluid communication with the injection port 116 of the nozzle 102. The additive fluid source 124 functions in a manner similar to the primary fluid source 108, in that it provides a volume of an additive fluid 126 and injects it into the additive line 122.

Moreover, to permit the additive fluid source 124 to be isolated from the rest of the apparatus 100, the additive line 122 is provided with an additive isolation valve 132, which serves to selectively close off the additive fluid source 124 and the additive line 122 from the rest of the apparatus 100.

The drain line 120, on the other hand, extends from the junction 118, thereby putting the auxiliary line 114 in fluid communication with a drain 128. The actual structure and function drain of the 128 may vary: it may simply be an outflow to a sanitary sewer system, or it may cooperate with a further apparatus for recapturing and treating the drained fluid.

For instance, it may be advantageous to configure the apparatus to execute a cleaning-in-place cycle, such as described below, wherein the drain 128 is not a "drain" in the sense of an outflow to a sewer or other such disposal means, but instead a mechanism for recapturing and recirculating the cleaning fluids, thereby minimizing the amount of fluid used for a cleaning cycle and reducing the amount of fluid eventually discharged to the environment.

In any case, a drain valve 130 is provided on the drain line 120, which serves to selectively permit fluid communication between the drain 128 and the additive line 122 & auxiliary line 114, and thus permit the drain 128 to be selectively closed off from the rest of the apparatus 100.

The operation of the apparatus 100 during a container-filling process is now discussed.

The apparatus 100 is first positioned so that the mouth 104 of the nozzle 102 is in fluid communication with the container C, as mentioned above. Following this, the drain isolation valve 130 is closed; this prevents any unintended leakage through the drain, thereby avoiding the wastage or contamination of any of the product liquid or additive liquid.

Next, the additive isolation valve 132 is opened, establishing fluid communication between the additive source 124 and the rest of the apparatus 100. Following this, the filling valve 110 is opened, and a volume of product fluid 112 flows through the filling line 106 and into the nozzle 102. Simultaneously, a volume of additive fluid 126 flows through the additive line 122 and the auxiliary line 114 into the nozzle 102, wherein it combines with the product fluid 112 to create a mixed fluid 134.

This mixed fluid is dispensed into the container C in a continuous flow; by controlling the relative flow rates of the product fluid 112 and the additive fluid 126, a desired concentration of the additive fluid in the mixed fluid 134 is achieved.

In this embodiment, the nozzle 102 is provided with a nozzle chamber 136, which forms an extension of the mouth 104. The nozzle 102, the nozzle chamber 136, the mouth 104, and the product fluid line 106 are all aligned so as to be substantially coaxial about the common longitudinal axis Z, as mentioned above.

The presence of the nozzle chamber 136 is particularly advantageous, in that it helps to collimate the flow of the product fluid 112 and cause a more laminar flow from the nozzle 102 into the container C. This is advantageous in that, by avoiding the turbulence and frothing associated with turbulent flow, the time required to fill the container C is reduced.

Similarly, it is desirable that the injection port 116 opens onto the flow of product fluid 112 as close to the centre thereof as possible, so as to minimize the disruption of this laminar flow into the container C. Moreover, to avoid spillage the diameter of the mouth 104 must be smaller than the opening of the container C.

To this end, the nozzle 102 is provided with an adaptor 135, which seats in the nozzle 102 as shown. The adaptor 135 narrows the mouth of the nozzle 102 to accommodate the container C, and extends the injection port 116, so as to achieve the desired performance characteristics described above. The adaptor 135 may be integral with the nozzle 102, provided as a removable but semi-permanently installed component, or it may be provided as a readily-interchangeable component so as to facilitate the use of the apparatus 100 for filling containers of differing sizes.

In this particular embodiment, the nozzle chamber 136 is provided in a tapered form, such that it narrows to a throat 138 proximate to the mouth 104. According to the Venturi principle, the flow of product fluid 112 through this throat will speed up as its pressure decreases.

Accordingly, the injection port 116 is disposed at the level of the throat 138. The localized region of low pressure generated by the flow of the product fluid 112 will help to draw the additive fluid 126 from the auxiliary line 114. This will, in turn, reduce the amount of energy required by the additive fluid source 124 to introduce the additive fluid 126 into the apparatus 100. Moreover, it may in certain implementations make it feasible to use additive fluids which would otherwise be too thick or viscous to be practicable.

The fact that the injection port 116 is disposed at the narrowest part of the nozzle chamber 136 is also advantageous in that the flow of additive fluid 126 will meet the flow of product fluid 112 as near as possible to the longitudinal axis Z, and thus cause a minimal amount of disruption to the laminar flow of the mixed fluid 134 as it proceeds from the mouth 104 into the container C.

The apparatus 100 is further provided with a dosing valve 140, disposed on the auxiliary line 114. The dosing valve 140 serves to precisely measure/meter the flow through the auxiliary line 114.

In the present embodiment, the dosing valve 140 is a proportional valve, which during the production of the mixed fluid 134 is opened to a degree such that the volumetric flow of the additive fluid 126 is proportional to the volumetric flow of the product fluid 112.

To this end, the apparatus 100 further comprises a flow meter 142. The flow meter 142 and the dosing valve 140 will cooperate to ensure that the additive fluid is mixed into the product fluid at a consistent proportion.

Of course, the dosing of the additive fluid 126 may be achieved in other ways. For instance, the dosing valve 140 may instead be operated as a simple two-position valve, which moves between fully-opened and fully-closed positions. In this way, the additive fluid 126 is dosed in a succession of pulses that are injected into the stream of product fluid 112. By controlling the frequency and duration of these pulses, the desired concentration of the additive fluid 126 in the product fluid 112 is realized.

Moreover, the provision of the flow meter 142 in the present embodiment should not be construed as obligating the provision of such a flow meter in every other embodiment. Where the rate at which the additive fluid source 124 provides the additive fluid 126 is sufficiently constant, the additive fluid 126 may be dosed such at a sufficiently consistent rate that a dosing valve 140 is sufficient without the need for the flow meter 142.

Other variations beyond these are possible, and the person of skill in the art will be readily capable of adapting the apparatus 100 so as to provide the proper dosing action.

In particular, it will also be noted that the invention is not limited to installations where there is only one system for introducing additive fluid. In FIG. 1, for instance, there are depicted a second additive line 144, a second additive fluid source 146, and a second additive isolation valve 148. The second additive line 144, second additive fluid source 146, and second additive isolation valve 148 are depicted in dashed lines, as they can be considered as examples of optional or variant configurations of the apparatus 100.

By providing a plurality of additive fluid sources and the associated structure, a single apparatus may be easily configured to fill containers with mixed fluids comprising several additive fluids, or to rapidly switch between additive fluids, or even to alternate between filling containers with product fluid 112 with a dose of additive fluid 126 and product fluid 112 without any additive fluid at all. In this way, the apparatus is provided with a great deal of flexibility.

In particular, by employing a plurality of additive fluid sources, a great deal of flexibility is achieved in the production of the apparatus 100. For instance, by selectively opening and closing the respective additive isolation valves for each of the additive fluid sources, the apparatus can produce successive containers having different additive fluids.

In the same way, any number of blends of additives may be created over a short run of containers. The proportion of the additive fluids 126, 150 relative to each other can be controlled by the relative openings of their respective isolation valves 132, 148; and the overall dose of the additive fluid blend is controlled by the dosing valve 140.

For example, the apparatus 100 provided with the additive fluid sources 124, 146 as shown is considered. An exemplary sequence of containers might comprise a first container with a dose of the first additive 126, a second container with a dose of a second additive 150, a third container with only product fluid 112 and no additives at all, and a fourth container with a dose of both the first and second additive fluids 126, 150. This sequence may be iterated to produce many such containers.

To achieve this, then, the additive fluid sources 124, 146, the additive isolation valves 132, 148, and the dosing valve 140 are operated so that for each container the proper additive fluid 126, 150 is injected at the proper volume, so as to achieve the correct concentration in the product fluid 112 for that container. This may, as in the case of the third container in the exemplary sequence mentioned above, mean that the volume of additive fluid is zero, or it may be some non-zero volume so as to achieve the desired proportion with the product fluid 112.

It will also be recognized that the timing of the injection of the additive fluids 126, 150 may be varied as appropriate. For instance, it may be preferable to inject the additive fluid 126, 150 prior to the injection of the product fluid 112, such that it is present in the bottom of the container C when the injection of the product fluid 112 begins and is thoroughly mixed therewith during the filling of the container C. Alternatively, the injection of the additive fluid may overlap with the injection of the product fluid, or be entirely concurrent therewith.

Moreover, when utilizing multiple additive fluid sources it will be recognized that it may be necessary to flush the auxiliary line when changing from one additive fluid to another, to ensure that there is no residual additive fluid present which may contaminate a subsequent container C. This can be simply achieved by momentarily closing the additive isolation valves 132, 148 and opening the drain isolation valve 130 so as to use a small amount of the product fluid 112 to flush the auxiliary line 114. In this way, cross-contamination of the additive fluids may be avoided. Of course, other methods of doing this may be envisioned.

Finally, once the sequence of containers C has been produced, it may be desirable to label the containers C according to the additive fluid(s), or lack thereof, disposed within. It may also be desirable to package a full sequence of containers together, for transport and sale. In this way, packages having containers with a variety of different products are quickly and easily produced.

Figure 2:
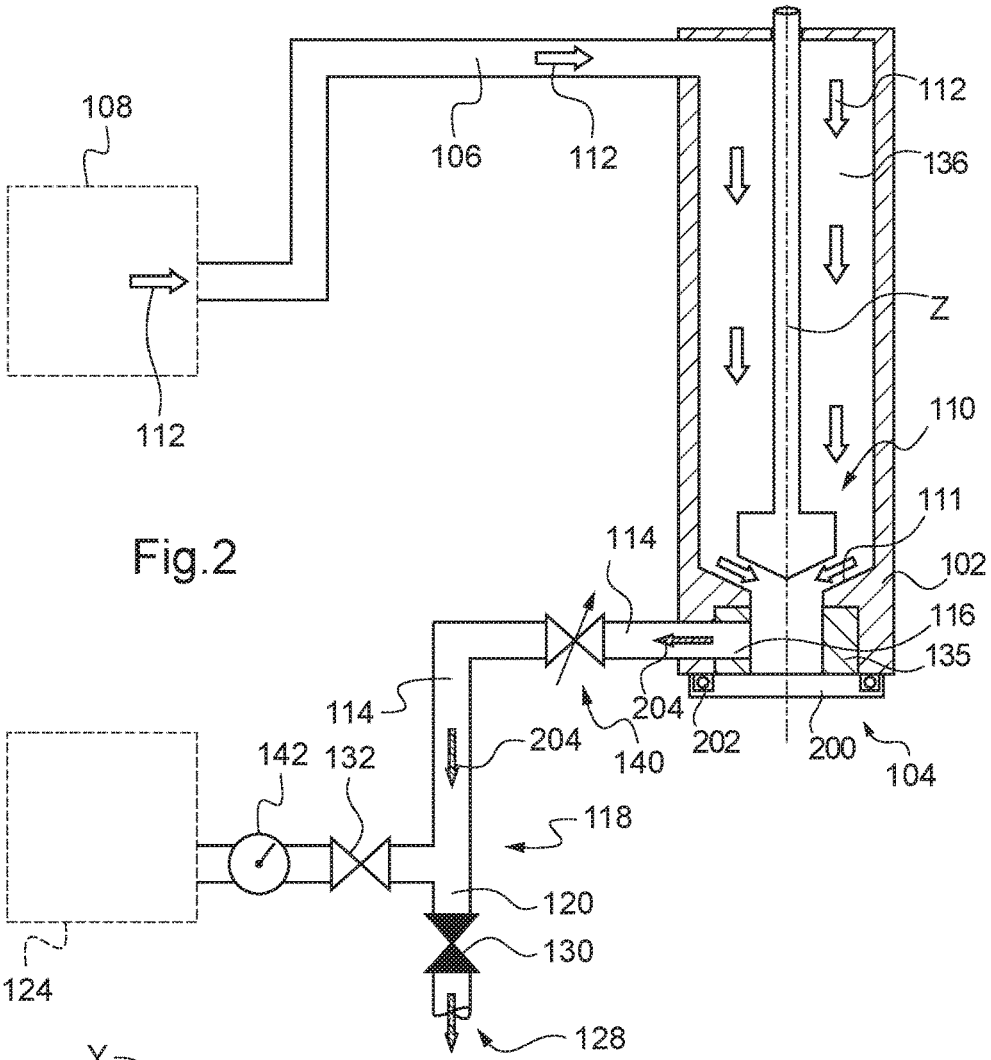
FIG. 2 is a schematic drawing of the container-filling apparatus of FIG. 1, during a cleaning process.

Turning now to FIG. 2, the apparatus 100 is depicted during the execution of a cleaning process. For the sake of clarity, the second additive line 144, second additive fluid source 146, and the second additive isolation valve 148 are omitted.

To effectuate the cleaning process, there is first provided an occlusion device 200. The occlusion device 200 is positioned such that it cooperates with the nozzle 102 to close off the mouth 104, here by way of the 0-ring 202 which, when the occlusion device is pressed into position against the nozzle, seals against the face of the nozzle 102.

This positioning may be accomplished by a number of means. For instance, the occlusion device 200 may be configured such that it is positioned by hand by an operator, and attached by means such as clips, screws or latches. Alternately, the occlusion device 200 may be held stationary as a part of the apparatus 100, whereupon the nozzle 102 is pressed into it by hydraulic, pneumatic, or mechanical actuators. This latter option may be particularly advantageous where the apparatus 100 forms a part of an automated production-line installation for producing filled containers.

In any case, once the occlusion device 200 is positioned, any fluid introduced into the nozzle 102 by the filling line 106 will necessarily exit through the injection port 116, and vice versa.

Once the occlusion device 200 is in place, the cleaning process begins. The filling valve 110, the dosing valve 140, and the drain isolation valve are all opened fully, while the additive isolation valve 132 is closed fully.

A cleaning fluid 204 is then injected into the filling line 106 by the primary fluid source 108. The cleaning fluid 204 will flow through the filling line 106, into the nozzle chamber 136 of the nozzle 102, out through the injection port 116, down the auxiliary line 114, past the junction 118, and down the drain line 120, whereupon it is ejected from the apparatus 100 through the drain 128.

In this way, the apparatus 100 is flushed and sterilized, in particular the portions of the nozzle chamber 136 and the nozzle 102 where the product fluid and the additive fluid are combined. Any traces of the additive fluid in the nozzle 102 are thus removed, allowing the apparatus 100 to utilize a different additive fluid, or no additive fluid, once the cleaning cycle is complete.

The cleaning fluid 204 can be provided in a number of different formulations; the exact formulation for any particular usage will depend greatly on the nature of the product fluid and the additive fluid in question.

For instance, in many food-grade installations, a full cleaning may be achieved by iterating the cleaning method described above over several iterations, including a first cycle using filtered/sterilized water as the cleaning fluid, then a cleaning cycle using a sodium hydroxide solution, then another water-rinse cycle, then a cycle using a nitric acid solution cleaning fluid, then a final rinse with water.

It may also be advantageous to follow up any cleaning cycle wherein the cleaning fluid is a liquid with a cycle that uses a treated gas, such as purified air or nitrogen. This will serve to chase out any residual cleaning fluid or moisture from the apparatus, thereby reducing the number of "wasted" containers at the restart of container filling due to the presence of residual cleaning fluid or rinse water. This will also serve to promote the cleanliness of the system in a general sense.

Figure 3:
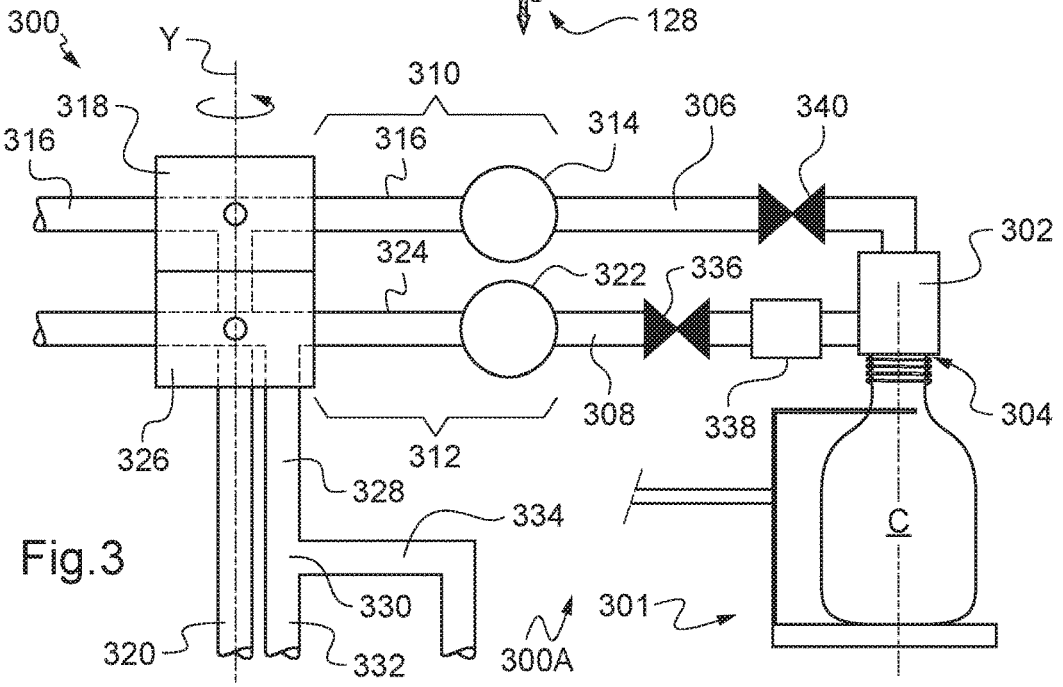
FIG. 3 is a representative drawing of an installation of a container-filling apparatus.

The integration of an apparatus according to the invention into a filled-container production system will now be discussed, in particular with reference to FIG. 3. FIG. 3 in particular illustrates how the structure and principles illustrated in FIGS. 1 and 2 may be adapted to a container-filling installation with multiple nozzles.

FIG. 3 depicts an installation 300, which is a carousel-type installation for filling containers formed as a composite of several container filling apparatuses 300A, which are each functionally similar to the apparatus 100 but structurally adapted to form a part of the grouped installation.

Such carousel-type apparatuses, which are commonly known and employed in the art, comprise a plurality of holders 301 (of which one is depicted here) which rotate about a central axis Y.

Each holder 301 is configured to hold in place a container C as it rotates along the circumference of the apparatus. The holders 301 may be provided in any of a number of different configurations, depending on the size and form of the container C. For instance, the holders 301 may be in the form of forks, engaging a ring provided on the neck of the container. Alternatively, the holders 301 may be provided as shelves, sockets, or similar structure upon which a container C may be disposed; the exact configuration may vary according to the particularities of the installation.

Through the rotation of the carousel, the installation 300 is easily adapted to work with a continuous production line, providing a continuous intake and output at a steady rate. As in the embodiment discussed in FIGS. 1 and 2, the carousel comprises a plurality of nozzles 302, each comprising a mouth 304 which cooperates with the container C disposed in the corresponding holder 301. Though the carousel could comprise several dozen separate holders 301 each with a corresponding nozzle 302, for the sake of simplicity only one of each is depicted here.

As in the preceding embodiment, each nozzle 302 of the installation 300 comprises a filling line 306 and an auxiliary line 308. However, since there are provided a plurality of nozzles 302, there is also a system for feeding each of the filling lines 306 and auxiliary lines 308 for each nozzle 302, in the form of the filling manifold 310 and the auxiliary manifold 312. The filling manifold 310 comprises a toroidal distributor line 314, from which each of the individual filling lines 306 are fed, and a plurality of spoke lines 316 (generally between 4 and 8, depending on the size of the installation 300) extending from a rotating union joint 318 disposed at the central axis Y of the apparatus.

Two of these elements are of particular interest. The rotating union joint 318 permits each of the spoke lines 316 to be fed from a single, stationary filling line 320. Meanwhile, the toroidal distributor line 314 permits a better balancing of the flow through the line.

In the same way, the auxiliary line 308 of each nozzle 302 is fed by the auxiliary manifold 312, which comprises a toroidal distributor line 322, a plurality of spoke lines 324, a rotating union joint 326, and a stationary auxiliary line 328. The stationary auxiliary line 228 comprises a junction 330, at which it separates into a drain line 332 and an additive line 334. The drain line 332 and the additive line 334 each function substantially as in the embodiment discussed with respect to FIGS. 1 and 2 (the additive isolation valve and drain isolation valve, as well as the additive fluid source, are not depicted here).

Owing to the fact that the installation 300 is provided with multiple nozzles 302, it will be apparent that there are several differences in the arrangement of its components which stem from this fact. In particular, there is provided a dosing valve 336, a flow meter 338, and a filling valve 340, outboard of the toroidal distribution lines 314 and 322, proximate to the nozzle 302. This is necessary to control the flow of product fluid and additive fluid through each individual nozzle 302, and thereby achieve a maximum precision in the dosing of the additive fluid when there are multiple containers C being filled at any given moment.

Of course, the exact arrangement of the components will depend in large part on the size, capacity, and overall configuration of the apparatus in question, and the person of skill in the art will recognize how and where to adapt the examples given here to meet the requirements of any particular implementation.

Also, it will be understood that an apparatus according to this invention, such as one depicted in the Figures and described above, may be useful in a number of different applications in a number of different industries. For instance, as noted above the apparatus 100 will be particularly useful in the preparation and packaging of edible fluids; in particular beverages are often produced by the mixing of a volume of edible flavouring syrup into a base fluid such as water or milk. For instance, soft drinks are commonly made from blending sweetened, flavoured syrup into carbonated water.

Of course, the product and additive fluids involved needn't necessarily be edible liquids. Rather, any fluid or fluid mixture which flows, or which can be made to flow such as by being blown through with a gas, could conceivably be produced as described above. For instance, an operation for the production of ready-mixed paints (which generally comprise a mixture of a resin or binder, a solvent such as water, a powdered or liquid pigment, and optionally additives to alter the qualities of the paint, such as gloss modifiers or fungicides) might be made significantly more flexible and efficient by an adaptation of the principles described above. Other possible applications may include mixtures of powdered substances, for instance flour, spices, ready-mixed plaster and cement, and many others.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

The invention claimed is:

1. An apparatus for filling containers, comprising:

a nozzle with a mouth configured to cooperate with a container and establish fluid communication therewith;

a filling line extending from the nozzle and establishing fluid communication between the mouth and a primary fluid source configured to introduce a volume of a product fluid into the filling line;

a filling valve selectively blocking fluid communication through the filling line;

an auxiliary line extending from the nozzle and establishing fluid communication between the mouth and a drain;

a drain isolation valve disposed in the auxiliary line and selectively blocking fluid communication with the drain;

at least one additive line extending from a junction with the auxiliary line between the nozzle and the drain isolation valve, and establishing fluid communication between the mouth and an additive fluid source configured to introduce a volume of an additive fluid into the at least one additive line; and a dosing valve disposed in the auxiliary line between the nozzle and the at least one additive line, the dosing valve being configured to permit a predetermined volume of additive fluid to flow through said auxiliary line to the nozzle.

2. The container-filling apparatus according to claim 1, wherein there is provided a plurality of additive fluid sources, each in communication with the nozzle through the auxiliary line and a respective additive line, each of the respective additive lines comprising an additive isolation valve.

3. The container-filling apparatus according to claim 1, wherein each at least one additive line comprises an additive isolation valve selectively blocking fluid communication through the additive line.

4. The container-filling apparatus according to claim 1, comprising a flow meter disposed on at least one additive line.

5. The container-filling apparatus according to claim 1, wherein the dosing valve is a proportional valve or a two-way valve.

6. An installation comprising a plurality of container-filling apparatuses comprising:

a nozzle with a mouth configured to cooperate with a container and establish fluid communication therewith;

a filling line extending from the nozzle and establishing fluid communication between the mouth and a primary fluid source configured to introduce a volume of a product fluid into the filling line;

a filling valve selectively blocking fluid communication through the filling line;

an auxiliary line extending from the nozzle and establishing fluid communication between the mouth and a drain;

a drain isolation valve disposed in the auxiliary line and selectively blocking fluid communication with the drain;

at least one additive line extending from a junction with the auxiliary line between the nozzle and the drain isolation valve, and establishing fluid communication between the mouth and an additive fluid source configured to introduce a volume of an additive fluid into the at least one additive line; and a dosing valve disposed in the auxiliary line between the nozzle and the at least one additive line, the dosing valve being configured to permit a predetermined volume of additive fluid to flow through said auxiliary line to the nozzle, at least some of the plurality of container-filling apparatuses having a common filling line and a common auxiliary line.

7. A method for producing a fluid product comprising an additive, comprising the steps of:

providing a container-filling apparatus comprising: a nozzle with a mouth configured to cooperate with a container and establish fluid communication therewith; a filling line extending from the nozzle and establishing fluid communication between the mouth and a primary fluid source configured to introduce a volume of a product fluid into the filling line; a filling valve selectively blocking fluid communication through the filling line; an auxiliary line extending from the nozzle and establishing fluid communication between the mouth and a drain; a drain isolation valve disposed in the auxiliary line and selectively blocking fluid communication with the drain; at least one additive line extending from a junction with the auxiliary line between the nozzle and the drain isolation valve, and establishing fluid communication between the mouth and an additive fluid source configured to introduce a volume of an additive fluid into the at least one additive line; and a dosing valve disposed in the auxiliary line between the nozzle and the at least one additive line, the dosing valve being configured to permit a predetermined volume of additive fluid to flow through said auxiliary line to the nozzle;

opening the filling valve, thereby causing a volume of a product fluid to flow through said filling line from the primary fluid source through the mouth of the nozzle; and opening the dosing valve and injecting a volume of an additive fluid into the at least one additive line, the volume of additive fluid being thereby conducted through the auxiliary line and into the nozzle, the additive fluid being thereby combined with the volume of product fluid flowing through the mouth of the nozzle.

8. The method according to claim 7, wherein the dosing valve is a proportional valve, the degree to which the dosing valve is opened being proportionate to the concentration of the additive fluid in the mixed fluid.

9. The method according to claim 7, wherein the dosing valve is a two-position valve, the dosing valve being opened during the injecting of the volume of additive fluid for a duration of time proportionate to the concentration of the additive fluid in the mixed fluid.

10. The method according to claim 7, wherein the additive fluid is an edible flavoring concentrate.

11. A method for filling a sequence of containers with a fluid product, comprising the steps of:

providing a container-filling apparatus comprising: a nozzle with a mouth configured to cooperate with a container and establish fluid communication therewith; a filling line extending from the nozzle and establishing fluid communication between the mouth and a primary fluid source configured to introduce a volume of a product fluid into the filling line; a filling valve selectively blocking fluid communication through the filling line; an auxiliary line extending from the nozzle and establishing fluid communication between the mouth and a drain; a drain isolation valve disposed in the auxiliary line and selectively blocking fluid communication with the drain; at least one additive line extending from a junction with the auxiliary line between the nozzle and the drain isolation valve, and establishing fluid communication between the mouth and an additive fluid source configured to introduce a volume of an additive fluid into the at least one additive line; and a dosing valve disposed in the auxiliary line between the nozzle and the at least one additive line, the dosing valve being configured to permit a predetermined volume of additive fluid to flow through said auxiliary line to the nozzle;

pre-determining the volume of at least one additive fluid in each container of the sequence of containers;

and for each of the containers in the sequence of containers, opening the filling valve, thereby causing a volume of a product fluid to flow through the filling line from the primary fluid source through the mouth of the nozzle and into one of a plurality of containers; and selectively injecting a volume of at least one additive fluid into a respective at least one additive line according to the pre-determined volume, the volume of the at least one additive fluid being subsequently conducted through the auxiliary line, the nozzle, and into the one of the plurality of containers.

12. The method according to claim 11, comprising a step for applying a distinctive marking to each of the plurality of containers, the distinctive marking corresponding to the additive liquid or liquids, or absence thereof, injected into each of the plurality of containers.

13. The method according to claim 11, comprising a step for gathering the containers produced over at least one iteration of the sequence into a package.

* * * * *